US011912453B2

(12) United States Patent
Ghiotti et al.

(10) Patent No.: US 11,912,453 B2
(45) Date of Patent: Feb. 27, 2024

(54) STRUCTURE FOR SUPPORTING AND TRANSPORTING A PLURALITY OF PIECES IN OPERATIONS OF ASSEMBLING/DISASSEMBLING AND/OR CHANGE OF CONFIGURATION IN A MANUFACTURING LINE AND METHOD FOR ASSISTING AN OPERATOR IN SUCH OPERATIONS

(71) Applicant: SASIB S.P.A., Bologna (IT)

(72) Inventors: Roberto Ghiotti, Bologna (IT); Matteo Orsoni, Bologna (IT)

(73) Assignee: SASIB S.P.A. (IT)

( * ) Notice: Subject to any disclaimer, the term of this patent is extended or adjusted under 35 U.S.C. 154(b) by 0 days.

(21) Appl. No.: 17/922,318

(22) PCT Filed: Apr. 23, 2021

(86) PCT No.: PCT/IB2021/053373
§ 371 (c)(1),
(2) Date: Oct. 28, 2022

(87) PCT Pub. No.: WO2021/224710
PCT Pub. Date: Nov. 11, 2021

(65) Prior Publication Data

US 2023/0127643 A1 Apr. 27, 2023

(30) Foreign Application Priority Data

May 7, 2020 (IT) ..... 102020000010156

(51) Int. Cl.
*B65B 59/04* (2006.01)
*B65B 57/18* (2006.01)
*B65B 65/00* (2006.01)

(52) U.S. Cl.
CPC ..... *B65B 59/04* (2013.01); *B65B 57/18* (2013.01); *B65B 65/003* (2013.01)

(58) Field of Classification Search
CPC ..... B65B 65/033; B65B 57/18; B65B 59/04
See application file for complete search history.

(56) References Cited

U.S. PATENT DOCUMENTS 2,016,421 A 10/1935 Eichner
3,908,800 A 9/1975 Drapeau
(Continued)

FOREIGN PATENT DOCUMENTS

DE 4332377 A1 3/1995
DE 20212267 U1 10/2002
(Continued)

OTHER PUBLICATIONS

International Search Report and Written Opinion of the International Searching Authority issued in International Application No. PCT/IB2021/053373, dated Jun. 29, 2021, 14 pages.
(Continued)

*Primary Examiner* — Anna K Kinsaul
*Assistant Examiner* — Himchan Song
(74) *Attorney, Agent, or Firm* — Dilworth IP, LLC

(57) ABSTRACT

A structure for supporting and transporting a plurality of pieces in operations of assembling/disassembling and/or change of configuration in a manufacturing line includes at least one support surface; a plurality of areas defined on the at least one support surface, each of the areas includes a respective piece of the plurality of pieces or being configured to house a respective piece of the plurality of pieces; and a plurality of warning devices selectively actuatable automatically, each warning device being associated to a respective area of the plurality of areas.

16 Claims, 3 Drawing Sheets

(56) References Cited

U.S. PATENT DOCUMENTS

| | | | | |
|---|---|---|---|---|
| 4,821,197 | A | 4/1989 | Kenik et al. | |
| 5,537,798 | A * | 7/1996 | Fukuda | B65B 59/003 53/201 |
| 11,505,354 | B1 * | 11/2022 | Bren | B65B 63/005 |
| 2008/0014072 | A1 | 1/2008 | Seggern | |
| 2013/0211575 | A1 | 8/2013 | Hahn | |
| 2016/0200467 | A1 * | 7/2016 | Cousins | B65B 11/025 53/556 |
| 2018/0127134 | A1 * | 5/2018 | Squires | B65B 65/00 |
| 2018/0148205 | A1 * | 5/2018 | Sander | B65B 43/14 |
| 2019/0018431 | A1 * | 1/2019 | Laible | G01P 13/0086 |
| 2020/0198824 | A1 * | 6/2020 | Wu | B65B 57/18 |
| 2020/0262593 | A1 * | 8/2020 | Brettschneider | B65B 57/00 |
| 2020/0277095 | A1 * | 9/2020 | Buchberger | B29C 66/91231 |
| 2021/0309398 | A1 * | 10/2021 | Kircher | B29C 66/872 |
| 2022/0004952 | A1 * | 1/2022 | Ghiotti | G06Q 10/06313 |
| 2022/0204203 | A1 * | 6/2022 | Gabusi | B65B 59/04 |

FOREIGN PATENT DOCUMENTS

| | | | |
|---|---|---|---|
| DE | 102011112658 | A1 | 3/2013 |
| EP | 2433875 | A1 | 3/2012 |
| FR | 2778593 | A1 | 11/1999 |

OTHER PUBLICATIONS

Observation submitted by a third party concerning the Patentability of European Patent Application No. 21720856.0-1016, dated Jan. 19, 2023, 23 pages (English Translation).

* cited by examiner

STRUCTURE FOR SUPPORTING AND TRANSPORTING A PLURALITY OF PIECES IN OPERATIONS OF ASSEMBLING/DISASSEMBLING AND/OR CHANGE OF CONFIGURATION IN A MANUFACTURING LINE AND METHOD FOR ASSISTING AN OPERATOR IN SUCH OPERATIONS

FIELD OF THE INVENTION

The present invention relates to a structure for supporting and transporting a plurality of pieces in operations of assembling/disassembling and/or change of configuration in a manufacturing line.

BACKGROUND

Throughout the present description and in the subsequent claims, the term manufacturing line is used to indicate to both any manufacturing line in which the handling of pieces for assembling/disassembling and/or for changing the configuration of one or more operating machines present in the manufacturing line is envisaged, and any manufacturing line in which the handling of pieces is aimed at assembling/disassembling an industrial product of various kinds, even in the absence of operating machines, such as an assembly line.

The term operating machine is used to generally indicate any machine arranged in any manufacturing line for automatically processing industrial products of various kinds, such as for example a packaging or wrapping machine of the tobacco industry. Further examples of operating machines are the machines for the production and/or packaging of confectionery products and the machines for the production and/or packaging of absorbent articles.

The term change of configuration is used to generally indicate the change of format and/or brand and/or material of the industrial product that can be processed in the manufacturing line. In the specific case in which the manufacturing line comprises one or more operating machines, such a change of format and/or brand and/or material requires an intervention on the operating machine, as discussed below.

Only for the sake of simplicity, reference will be made below to the case in which the manufacturing line comprises operating machines as defined above and therefore to operations of assembling/disassembling and/or change of configuration of these operating machines.

The operating machines to which reference will be made have a fixed part and a plurality of pieces that can be mounted/dismounted in/from the fixed part and possibly replaced. Normally, the fixed part is not subject to modifications and/or replacements of pieces in ordinary circumstances, unless there are any breakages or special maintenance interventions.

The aforementioned pieces typically comprise components of the machine which interact with the industrial product processed by the operating machine, such as for example drums, levers, pushers, etc. The characteristics of these pieces depend on the properties of the product to be processed, such as the format of the product, the materials used in the product and the brand of the product. The possible replacement of the aforementioned pieces with other pieces having different characteristics allows changing the configuration of the operating machine adapting it to the characteristics of the product that one wishes to process each time. The operating machines can therefore operate in different configurations, and therefore process products with different characteristics, after replacing a certain quantity of pieces.

For example, in the case of packaging machines in the tobacco industry, it is possible to vary the number and size of cigarettes in a pack, with consequent variation in the format and/or shape of the pack itself.

Typically, during normal operation of the operating machine, the pieces correlated to the format and/or brand and/or material of the desired product are mounted on the fixed part. Further pieces correlated to possible different formats and/or brands and/or material of product are kept in the warehouse.

Operating machines of this type are provided with manuals that show to the operators the steps to be made for assembling/disassembling and/or for the change of configuration.

The assembly of an operating machine comprises mounting various pieces according to a predetermined sequence of operations so as to prepare the machine to operate in a desired configuration. The mounting operations are typically preceded by an operation of selecting in the warehouse the pieces to be mounted among a plurality of other pieces correlated to possible different configurations of the operating machine.

The disassembly of an operating machine comprises dismounting pieces according to a predetermined sequence of operations. The dismounting operations are typically followed by an operation of housing the dismounted pieces in suitable housing zones provided in the same warehouse that houses the pieces to be mounted.

The change of configuration of an operating machine comprises a sequence of operations of dismounting the pieces correlated to a previous configuration and of mounting pieces correlated to a desired configuration. These operations can be performed on one or more sectors of the machine by a single operator or by several operators working simultaneously.

The Applicant has noted that the operations of assembling/disassembling and/or change of configuration of the operating machines are often complicated and may require long times and the use of specialized operators.

Furthermore, the Applicant has found that operations on the operating machine are often affected by human errors which can cause a greater waste of time and resources and can create dangerous situations for the operators.

The Applicant has also found that, in cases where the aforementioned operations require the intervention of more than one operator, difficulties and inefficiencies may occur in coordinating the operations carried out by an operator with those carried out by another operator, with a consequent increase in the intervention times.

In the Applicant's opinion, the paper manuals used to guide the operations on the operating machine are often excessively long and complex and the consultation of the manuals causes a further waste of time and the risk of diverting the attention of the operators from the manual operations to be performed, increasing the risk of human errors.

Furthermore, the Applicant has noticed that pieces that are different from each other and intended to be mounted on the operating machine in different positions can often appear similar to each other. The Applicant has perceived that similar pieces can be inadvertently taken by mistake by the operators and mounted on the operating machine or placed in the warehouse in a wrong position.

In the Applicant's opinion, the search and selection in the warehouse of the pieces to be mounted on the operating machine and the transport of the same pieces from the warehouse to the operating machine or vice versa can be burdensome in terms of time and are possible sources of errors for the operators.

For these reasons, the Applicant has perceived that the provision of suitable measures to improve the arrangement and organization of the pieces to be mounted on the operating machine or of the pieces previously dismounted from the operating machine would reduce the times, costs and the possibility of human errors associated to the assembly, disassembly and/or change of configuration of an operating machine.

Furthermore, the Applicant has perceived that the aforementioned measures would allow the use of less specialized operators, with consequent savings in terms of costs.

SUMMARY

The present invention therefore relates, in a first aspect thereof, to a structure for supporting and transporting a plurality of pieces in operations of assembling/disassembling and/or change of configuration of a manufacturing line, comprising:

- at least one support surface;
- a plurality of areas defined on said at least one support surface, each of said areas comprising a respective piece of said plurality of pieces or being configured to house a respective piece of said plurality of pieces;
- a plurality of warning devices selectively actuatable automatically, each warning device being associated to a respective area of said plurality of areas.

Throughout the present description and in the subsequent claims, the expression "actuatable automatically" is used to indicate an activation that occurs upon receipt of a signal without any operator intervention. This signal, which is preferably of the electrical or radio type and which can be generated by a control unit located in a remote position with respect to the structure or by a control device installed on the structure, commands the activation of a respective warning device and guides the operator in the various operations to be performed.

In a second aspect thereof, the present invention relates to a method for assisting an operator in operations of assembling/disassembling and/or change of configuration in a manufacturing line.

The aforementioned method comprises:

- providing a structure in accordance with the first aspect of the present invention;
- positioning the structure close to a manufacturing line;
- picking a piece arranged in a respective area of said plurality of areas to use said piece later in the manufacturing line or placing in a respective area of said plurality of areas a piece picked from the manufacturing line;
- wherein said respective area is identified by selectively actuating the respective warning device upon receipt of a respective command of a predetermined sequence of commands correlated to at least some of said operations of assembling/disassembling and/or change of configuration.

In both the aspects described above, during the operations of assembling/disassembling and/or change of configuration of the operating machine, the areas of the support surface of the structure can both house pieces intended to be mounted on the operating machine and possibly receive pieces dismounted from the operating machine so as to allow an orderly arrangement of each piece in a defined position, or vice versa. Furthermore, when the operating machine is operating in a certain configuration, the structure can be removed from the operating machine while waiting for its subsequent use or taken to a storage area (or warehouse) for positioning on the structure the pieces to be mounted on the operating machine in a subsequent operation of change of configuration or for picking from the structure pieces dismounted from the operating machine.

The warning devices associated to the respective areas allow to signal to the operators in charge the position of a piece to be mounted on the operating machine or the position of an area intended to house a piece dismounted from the operating machine, without the need to consult the manuals. This measure saves operators the time to search for the correct position and considerably reduces the possibility of incorrect picking and positioning of the pieces.

In at least one of the aforementioned aspects, the present description can have at least one of the preferred characteristics described below, taken singularly or in combination.

Preferably, the structure comprises at least one additional warning device selectively actuatable automatically and associated to a main face of the structure.

When placed in a storage area together with a plurality of similar structures, the structure can be positioned so that the main face is exposed and easily visible to operators. The additional warning device associated to the main face allows to signal to the operators the position of the structure to be picked for the subsequent operations on the operating machine.

Preferably, the structure comprises at least one additional warning device selectively actuatable automatically and associated to the at least one support surface. If the structure comprises several support surfaces, a respective additional warning device can be provided on each of them.

This additional warning device allows to signal to the operators the support surface on which to operate, for example the support surface on which one or more pieces to be mounted on the operating machine are located or the support surface intended to house one or more pieces removed from the operating machine. This is particularly advantageous when several operators operate on a single structure.

Preferably, said warning devices comprise respective light sources selectively actuatable automatically.

The activation of the light sources immediately signals to the operators the position of the piece or the area correlated to the operation to be performed immediately after.

In various preferred embodiments, each of said light sources can be configured to emit a steady light or an intermittent light.

Each of said light sources can also be configured to selectively emit a steady or intermittent light.

Preferably, each of said light sources is configured to emit light of a colour selected from a group of preferred colours. In this context, white is also considered a colour.

In some preferred embodiments, each of said light sources is configured to adjust the colour of the light among the colours of the group of preferred colours.

The possibility of emitting light of different types and colours makes it possible to provide additional information in a simple and effective way to operators. For example, each colour and/or type of light of a warning device can be associated to an operator of a group of operators to whom the operation correlated to the area or piece to which that particular warning device is associated has been assigned, so as to effectively coordinate various operators who operate on the same operating machine. The operating machine can also be divided into sectors and the colour and/or type of light emitted by a warning device associated to an area of the structure indicates that the piece housed in that area is intended for a particular sector or that the area is intended to receive a piece from a particular sector.

Preferably, the structure comprises a plurality of identification devices, each identification device being associated to a respective area of said plurality of areas.

The identification devices uniquely identify the respective areas of the structure from which the pieces to be mounted on the operating machine have to be picked or in which the pieces dismounted from the operating machine have to be housed and allow to verify that each of the required operations has been actually performed as well as the correctness of this operation in order to proceed with the subsequent operation.

For example, it is possible to pick a piece from an area of the structure and, immediately before or after picking that piece from that area, to confirm, by reading the identification device associated to that area, that the piece has been picked from the correct area.

It is also possible to house a piece dismounted from the operating machine at an area of the structure and, immediately before or after housing this piece in that area, to confirm by reading the identification device associated to this area that the piece has been housed in the correct area.

Preferably, each identification device comprises a respective warning device. It is therefore preferable to incorporate in a single device both the warning function and the function of identifying the various areas provided on the structure, so as to reduce the operations of assembly of the structure itself.

Preferably, at least some of said identification devices comprise a respective electronic display configured to display an identification code of the piece arranged in the respective area or of the piece to be housed in said respective area.

In this description and in the subsequent claims, the term "electronic display" is used to indicate a display configured to digitally display numbers, letters, bar codes, datamatrix, QR codes, information in general or any other coding form (such as for example instructions or warnings for the operator associated to the piece arranged or to be housed in a respective area of the structure) and which is programmable or controllable to display different numbers or information.

The provision of the electronic display allows to set and modify the identification codes according to the needs. For example, the same area of the structure can be used to house different pieces in different operating steps and the electronic display allows to modify the code which is shown according to the piece which is housed.

In one embodiment, at least some of said identification devices comprise a transmitter or a transponder configured to communicate the aforementioned identification code.

In particularly preferred embodiments, at least some of said identification devices comprise an electronic label.

Preferably, at least some of said electronic labels are luminous electronic labels.

The electronic luminous labels comprise an electronic display and one or more LEDs arranged at the edges of the electronic display. The electronic display forms part of the identification device and the LEDs form part of the relative warning system.

In one embodiment, the structure comprises a plurality of sensors, each sensor being associated to a respective area and configured to detect a verification signal.

Preferably, said plurality of sensors comprises proximity sensors configured to detect the presence of a piece in the respective area.

In some embodiments, said plurality of sensors may comprise, also or only, touch sensors configured to detect touch inputs from an operator.

In other embodiments, said plurality of sensors may comprise, also or only, biometric sensors configured to detect biometric inputs of an operator.

The plurality of sensors may also comprise identification sensors, for example RFID sensors, configured to detect an identification signal.

Preferably, the structure comprises a control device operatively connected to said plurality of warning devices to receive a first control signal and automatically actuate and/or adjust each warning device selectively based on said first control signal.

Preferably, the control device is operatively connected also to each additional warning device to receive also a second control signal and to actuate and/or adjust the additional warning device based on said second control signal.

Preferably, the control device is operatively connected to said plurality of identification devices to receive a third control signal and to set the identification devices based on the third control signal.

In the embodiments in which the aforementioned sensors are used, the control device is operatively connected to said plurality of sensors to receive the detected signal/input from said sensors and to transmit said signal/input to a control unit.

Preferably, the control device comprises a receiving sub-unit configured to receive radio signals from a remote control unit, said radio signals comprising said first control signal and/or said second control signal and/or said third control signal.

In one embodiment, the structure comprises a control unit connected or integrated with the control device, said control unit comprising a memory sub-unit and being configured to generate said first and, preferably, said second control signals based on instructions saved in said memory sub-unit.

Preferably, at least some of said areas comprise respective support members configured to reversibly support respective pieces of said plurality of pieces in said at least one support surface.

Preferably, said at least one support surface is associated with a base provided with a plurality of wheels.

Preferably, the structure comprises two support surfaces.

In this way, for example, it is possible to dedicate one support surface for housing the pieces dismounted from the operating machine and the other support surface for housing the pieces to be mounted on the operating machine.

Preferably, the two support surfaces face opposite sides, so as to maximize the capacity of housing the pieces of the structure by minimizing the overall dimensions thereof and also allowing the operator to work easily on each support surface or on both.

Preferably, the structure comprises a frame having a rectangular plan shape with two long sides and two short sides, said support surfaces being arranged at the long sides and said main face being arranged at a short side.

BRIEF DESCRIPTION OF THE DRAWINGS

Further characteristics and advantages of the present description will become clearer from the following detailed description of preferred embodiments thereof, made with reference to the attached drawings and provided by way of indicative and non-limiting example, wherein.

DETAILED DESCRIPTION

An embodiment of a structure for supporting and transporting a plurality of pieces in operations of assembling/disassembling and/or change of configuration of a manufacturing line, and in particular of an operating machine arranged in the manufacturing line, in accordance with the present invention is indicated in the attached figures with the numerical reference 1 and is referred to hereinafter with the abbreviated notation "structure 1".

The structure 1 can be used to house pieces 100 of the operating machine. The structure 1 can be positioned in a storage environment, for example a warehouse, together with a plurality of similar structures according to an ordered arrangement, for example with the different structures arranged side by side with each other with the same orientation.

The structure 1 can also be used to transport the pieces 100 from the storage environment to a working environment close to an operating machine.

The structure 1 is arranged at a distance from the operating machine and from any obstacles present in the working environment sufficiently to allow one or more operators to pick pieces 100 from the structure 1 in order to mount them on the operating machine and/or to dismount pieces 100 of the operating machine in order to place them on or in the structure 1.

Figure 1:
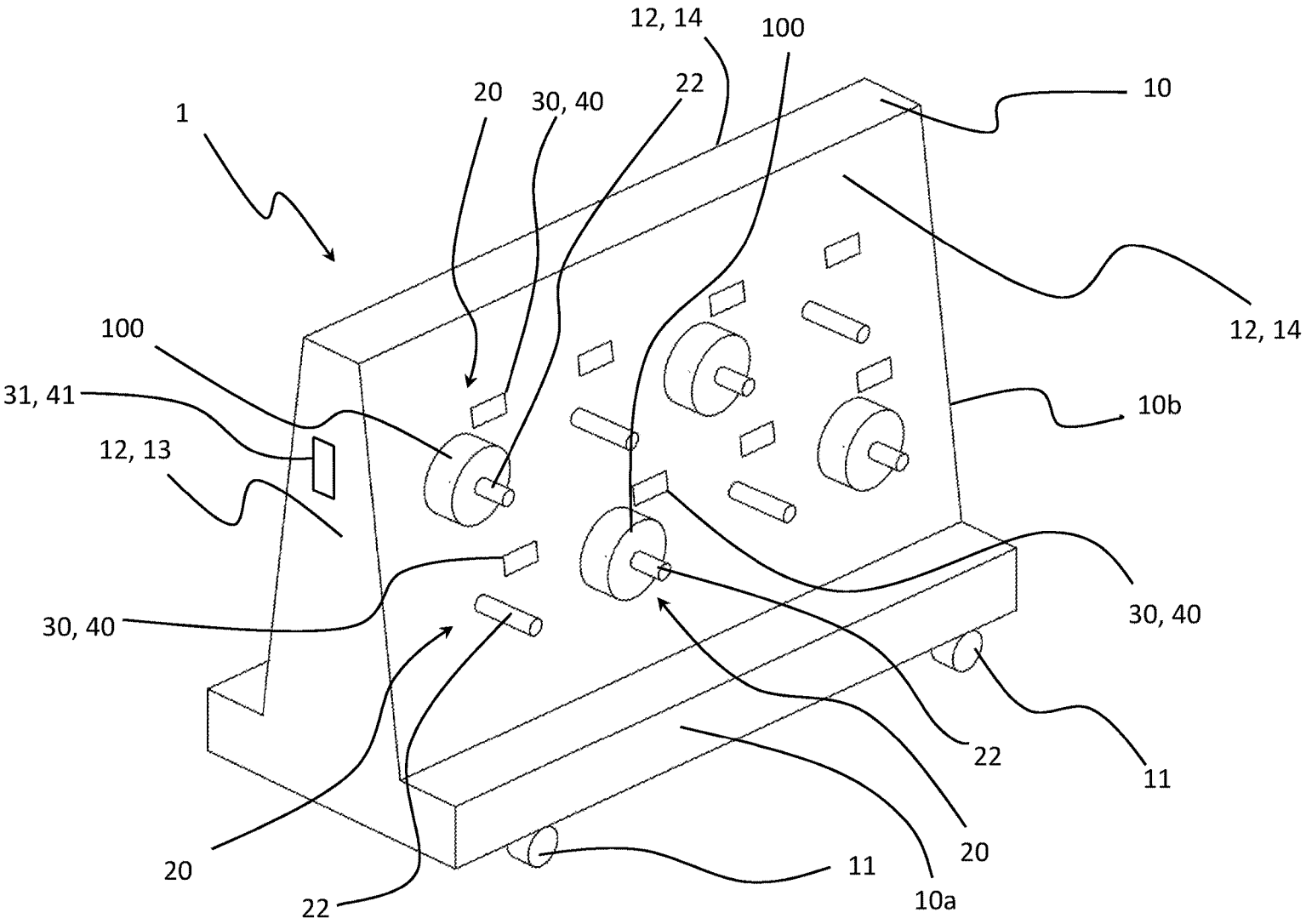
FIG. 1 shows a simplified perspective view of an exemplary embodiment of a structure for supporting and transporting a plurality of pieces in operations of assembling/disassembling and/or change of configuration of a manufacturing line in accordance with the present invention.

In the embodiment shown in FIG. 1, the structure 1 comprises a frame 10 having a base 10*a* and a main portion 10*b*. Furthermore, the structure 1 comprises a plurality of wheels 11 connected to the base 10*a* so as to allow the movement of the structure 1 on a paved surface. The wheels 11 can be free, in this case the structure 1 has the shape of a trolley and can be moved manually by the workers, for example by pushing it or by means of suitable gripping members or handles (not shown).

Alternatively, a motor (not shown) can be provided which drives the wheels 11 for a motorised movement of the structure 1.

In other embodiments not shown, the structure 1 may not be provided with wheels 11 and can be moved manually by an operator, for example after manually lifting the structure 1. In these embodiments, the structure 1 can have the shape of a shelving or a crate or a box or a case and is suitable for applications in which the number and size and weight of the pieces 100 to be supported and transported is sufficiently small to allow manual handling. For this purpose, the presence of one or more lifting members can be provided which can be used by the operators to manually lift the structure 1 in order to transport it.

The main portion 10*b* of the frame 10 comprises a plurality of lateral faces 12 (four in the example of FIG. 1), exposed laterally so as to be visible and accessible to the operators.

The plurality of lateral faces 12 comprises at least one main face 13, arranged so as to be exposed and visible to the operators when the structure 1 is placed side by side with a plurality of similar structures 1 according to an ordered arrangement.

In the embodiment herein shown, the base 10*a* of the frame 10 has a rectangular plan shape and each lateral face 12 of the main portion 10*b* of the frame 10 has a substantially trapezoidal shape. The main face 13 is arranged at one of the two short sides of the base 10*a*.

The main portion 10*b* of the frame 10 comprises, at at least some of the lateral faces 12, a support surface 14 which, at least when the structure 1 is arranged close to the operating machine, is exposed and accessible to an operator.

The preferred embodiments of the structure 1, such as for example the one shown in FIG. 1, can comprise two support surfaces 14 facing opposite sides and arranged on respective lateral faces 12 that are different from the main face 13, in particular on the two lateral faces 12 arranged at the long sides of the base 10*a*. In the embodiment of FIG. 1, the support surfaces 14 have an angle comprised between 1° and 30° with respect to a vertical plane, so as to improve the stability of the pieces 100 on the support members 22 described below.

Each support surface 14 has a plurality of areas 20 configured to house respective pieces 100, so that an operator can place a piece 100 dismounted from the operating machine on or in a respective free area 20 or pick a piece 100 from an area 20 which houses it to mount it on the operating machine.

Some of the areas 20 can have a support member 22, configured to support and optionally reversibly fix a piece 100 in the respective area 20 in a defined position. Each support member 22 can be specific or it can be configured to reversibly fix a plurality of pieces 100 that are different from each other. In the embodiment of FIG. 1, each support member 22 comprises a shaft bound to the frame 10 and configured to be fitted into a hole of a respective piece 100, such as for example a drum.

In some embodiments not shown, the support surface 14 can have, at at least some areas 20, recessed seats or support planes configured to house or support respective pieces 100, whatever their shape.

The plurality of areas 20 can be defined on each of the two support surfaces 14. In this case, one of the two support surfaces 14 can comprise areas 20 which house the pieces 100 to be mounted on the operating machine, while the other of the two support surfaces 14 can comprise areas 20 intended to house the pieces 100 dismounted from the operating machine.

Some of the pieces 100 housed on the support surface(s) 14, or on other zones of the structure 1, may be tools intended to be used by the operator for mounting other pieces on the operating machine or for dismounting other pieces from the operating machine.

The structure 1 comprises a plurality of warning devices 30 fixed to the frame 10. Each warning device 30 is arranged close to or at a respective area 20 and is configured to emit a signal perceivable by an operator so that the operator can uniquely associate the perceived signal to the respective area 20.

Preferably, the signal is a light signal. In an alternative embodiment not shown, the signal is of the acoustic type.

In preferred embodiments of the structure 1, each warning device 30 comprises at least one light source, for example one or more LEDs. The light source can be configured to emit a steady or intermittent light, or to selectively emit a steady and intermittent light. Furthermore, the light source can be configured to emit light of a specific colour or light of a colour selectively selected from a preferred group of colours.

The warning devices 30 are positioned on the support surfaces 14 so as to be exposed and visible to the operators. The characteristics and intensity of the light emission of the warning devices 30 are configured to capture the attention of the operator or operators during the operations to be performed on the operating machine to guide them during these operations.

The structure 1 further comprises a plurality of identification devices 40, each arranged at or close to a respective area 20.

In preferred embodiments of the structure 1, each identification device 40 comprises an electronic display 45 configured to display an identification code 46, for example a bar code (preferably a datamatrix), an alphanumeric code or a QR code. The identification code 46 can be modified and uniquely identifies the piece 100 housed in the respective area 20 or intended to be housed in this area 20. Furthermore, the identification device 40 is arranged so as to be read by an operator by means of a suitable portable reading device. In one embodiment, the electronic display 45 can be configured to display simple instructions and/or videos relating to operations to be performed by the operators.

Figure 3:
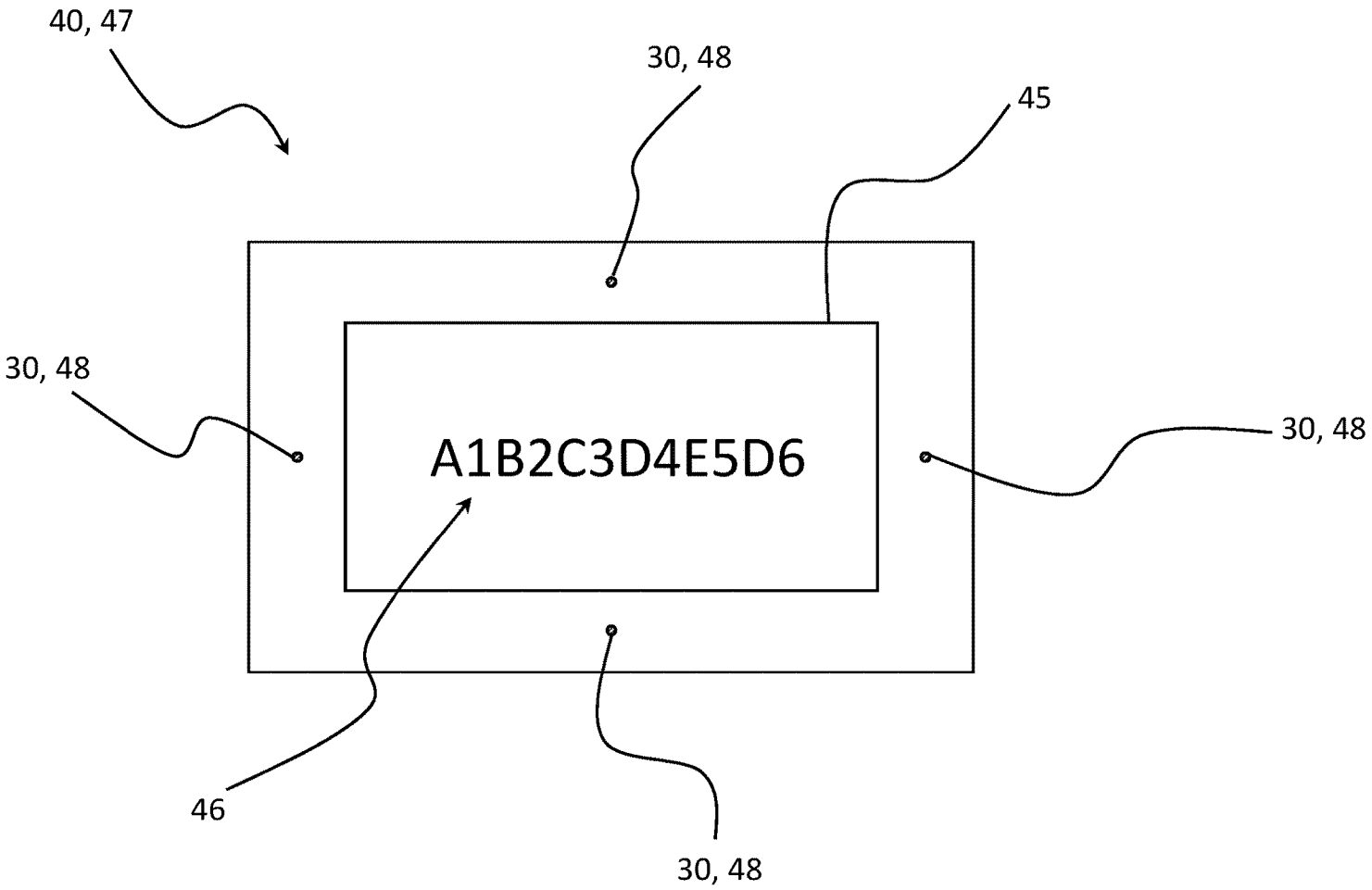
FIG. 3 shows a schematic view of an enlarged detail of the structure of FIG. 1.

In the preferred embodiment, each identification device 40 comprises an electronic tag 47, schematically shown in FIG. 3. The electronic tag 47 incorporates the warning device 30 associated to the same area 20 to which it is associated.

Preferably, the electronic tag 47 comprises the electronic display 45 described above and a plurality of LEDs 48 arranged around the electronic display 45, which constitute the aforementioned warning device 30.

In a first alternative embodiment not shown, the identification device 40 comprises a tag or label on which an identification code associated to the respective area 20 is printed.

In a second alternative embodiment, the identification device 40 comprises a transmitter device, for example of the NFC (Near Field Communication) type or a transponder, for example of the RFID (Radio Frequency Identification) type, configured to emit the respective identification code via radio or magnetically so that it can be read by a receiver device.

In an embodiment in which the use of a plurality of structures similar to the structure 1 described above is provided, each structure 1 of the plurality of structures can comprise an additional warning device 31 and an additional identification device 41, similar to those described above. Such additional warning devices 31 and identification devices 41 are used to allow spotting and identifying the structure 1 by an operator. They are arranged on the main face 13 so as to be exposed and visible when the structure 1 is placed side by side with similar structures, with the respective support surfaces 14 facing one another.

Furthermore, in the case in which the structure 1 comprises a plurality of support surfaces 14, the structure 1 can comprise a plurality of additional warning devices 31, each associated to a respective support surface 14, so as to signal to the operator the specific support surface 14 from which the pieces 100 intended to be mounted on the operating machine must be picked or on which the pieces 100 dismounted from the operating machine must be placed.

In an embodiment not shown, the structure 1 comprises a plurality of sensors, each associated to a respective area 20 and configured to detect a verification signal confirming that an operator has picked a piece 100 from the respective area 20 to mount it on the operating machine or has placed a piece 100 dismounted from the operating machine in the respective area 20.

For example, proximity sensors can be provided, the proximity sensors being arranged and configured so as to detect the presence or absence of a piece 100 in the respective area 20.

Alternatively, or in combination with other sensors, touch sensors can be provided, the touch sensors being configured to detect touch inputs of an operator aimed at confirming an event like for example that a specific operation of picking a piece 100 from the respective area 20 or of housing a piece 100 in the respective area 20 has been successfully performed.

Alternatively, or in combination with other sensors, biometric sensors can be provided, the biometric sensors being configured to detect biometric inputs of an operator aimed at confirming the identity of the operator and/or confirming an event like for example that a specific operation of picking a piece 100 from the respective area 20 or of housing a piece 100 in the respective area 20 has been successfully performed.

Alternatively, or in combination with other sensors, identification sensors can be provided, for example RFID, the identification sensors being configured to detect an identification signal. For example, the pieces 100 can be configured to emit respective identification signals and each identification device can be configured to identify a respective piece 100 at a respective area 20 to verify the correct positioning thereof. Alternatively, one or more identification sensors can be used to read an identification signal associated to an operator, for example by means of a personal card, in order to verify the identity of the operator.

Figure 2:
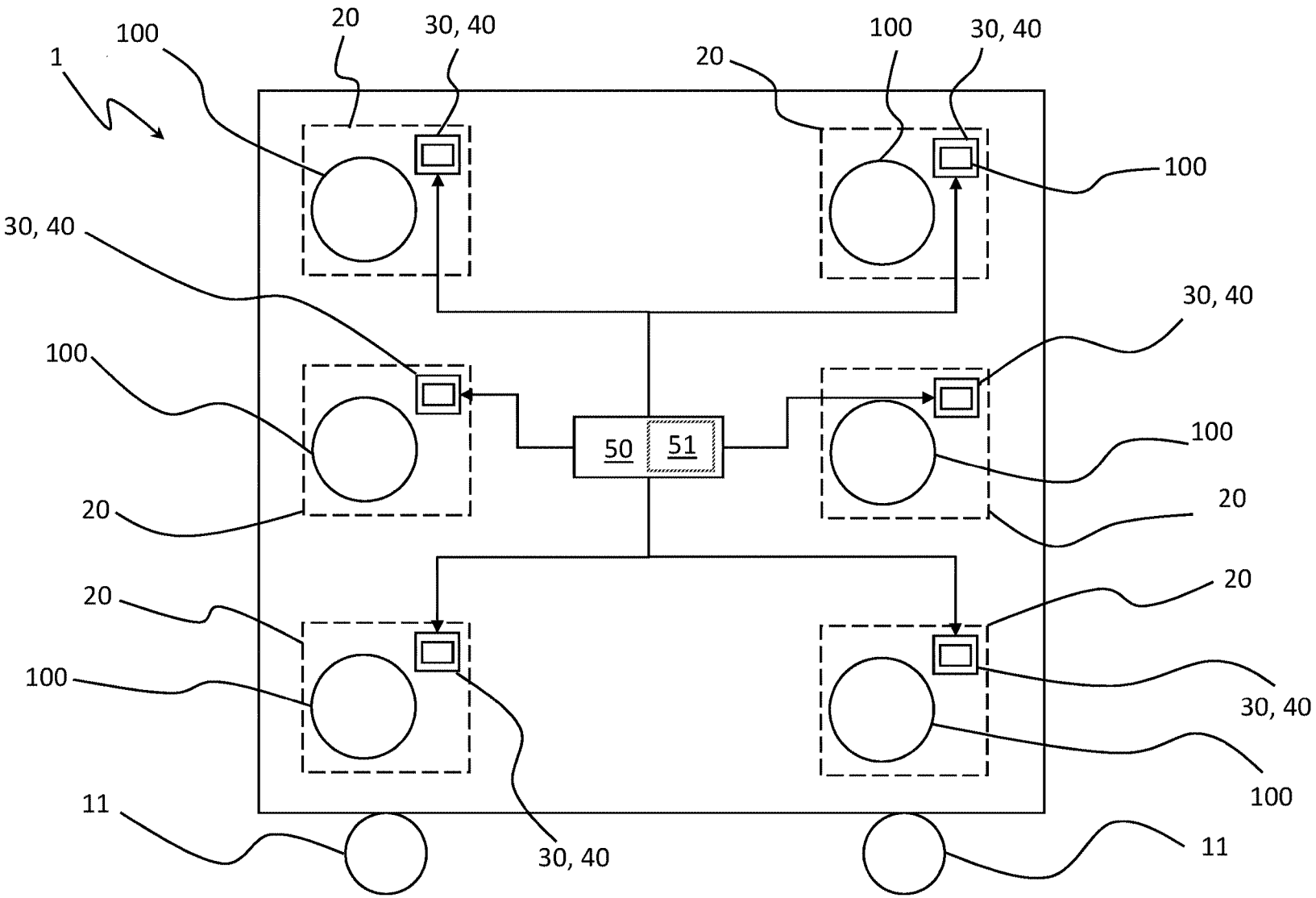
FIG. 2 shows a schematic view of the structure of FIG. 1.

The structure 1 further comprises a control device 50 (FIG. 2) operatively connected to the warning devices 30 and to each possible additional warning device 31, for example by means of electrical connections. The control device 50 is also configured to receive control signals emitted by a control unit.

In the preferred embodiment the control unit is remote, i.e. it is separated from the structure 1 and can be operably connected to the control device 50 by means of a wireless connection, for example via radio. For example, the control unit can be integrated into an independent computer or connected to the operating machine.

The control device 50 comprises a receiving sub-unit 51 configured to establish a radio connection with the remote control unit in order to receive the control signals.

In a possible alternative embodiment, the control unit is integrated into the structure 1 and connected to the control device. In this embodiment the control unit and the control device can be integrated into a same electronic circuit.

The control unit comprises a memory sub-unit and generates the control signals based on instructions saved in the memory sub-unit. The instructions relate to a predetermined series of operations intended to be performed by one or more operators in order to assemble the operating machine, disassemble the operating machine and/or change the configuration of the operating machine. Such operations may comprise: picking a piece from a predetermined area 20 of the structure 1, mounting a piece 100 on the operating machine in a predetermined position, dismounting a piece 100 from the operating machine, or placing a piece 100 dismounted from the operating machine at a predetermined area 20 of the structure 1.

The control signals comprise a first control signal containing instructions about the selective and automatic activation and/or deactivation of the warning devices 30 during the operations on the operating machine. In particular, the first control signal contains instructions for activating a warning device 30 associated to an area 20 which houses a piece 100 which is to be picked in a current or immediately subsequent step of the operations. Furthermore, the first control signal contains instructions for activating a warning device 30 associated to an area 20 intended to house a piece 100 to be dismounted from the operating machine in a short time or which is currently dismounted.

The control device 50 is configured to receive a first control signal and to selectively and automatically activate one or more warning devices 30 based on instructions contained in the first control signal. The activation of a warning device 30 signals to the operators assigned to the operations on the operating machine the position on the structure 1 of a piece 100 to be mounted on the machine or of an area 20 intended to house a piece 100 dismounted from the operating machine.

In the embodiment in which the use of a plurality of structures 1 of the type described above is provided, the operations to be performed by the operators can comprise picking a predetermined structure 1 from the storage environment and moving it close to the operating machine or removing a predetermined structure 1 from the operating machine and positioning it in the storage environment. In this embodiment, the control device 50 is configured to receive a second control signal which contains instructions about the selective activation and/or deactivation of each additional warning device 31, if any. For example, the second control signal contains instructions to activate the additional warning device 31 associated to the main face 13 of the structure 1 which houses the plurality of pieces 20 to be mounted on the operating machine, or to the support face 14 which houses the plurality of pieces 20 to be mounted on the operating machine. Furthermore, the second control signal can contain instructions to activate the additional warning device 31 associated to the main face 13 of the structure 1 having a plurality of areas 20 intended to house the plurality of pieces 100 to be dismounted from the operating machine or to the support face 14 which houses the plurality of pieces 20 to be mounted on the operating machine.

In the case in which the warning devices 30 are configured to emit selectively a steady or intermittent light, the first and second control signals can contain instructions about the type of light to be emitted and the control device 50 is configured to activate the emission of light provided on the respective warning device 30 based on the instructions contained in the first control signal. Similarly, if the warning devices 30 are configured to emit a light of a colour that can be selected from a group of different colours, the first control signal contains instructions about the colour to be selected and the control device 50 is configured to activate the emission of light of the desired colour on the respective warning device 30 based on the instructions contained in the first control signal. These measures can be used to provide additional information to the operators assigned to the operations to be performed on the operating machine. For example, if a plurality of operators is expected to perform operations on the operating machine, each operator can be assigned a different type or colour of light, so that each operator is guided towards the area 20 of the structure 1 correlated to the operations assigned to him.

The control device 50 can also be operatively connected to the identification devices 40, for example by means of electrical connections. In this case, the control signals comprise a third control signal containing instructions correlated to the identification code 46 to be displayed on each electronic display 45 of the identification devices 40. This identification code 46 relates to a piece 100 housed in the respective area 20 or to a piece 100 to be placed at the respective area 20 and can be read by a portable reading device to send to the control unit a confirmation signal of the start or completion of an operation correlated to that piece 100.

The control device 50 is configured to control the identification devices 40 so as to set the identification code 46 thereof according to the instructions contained in the third control signal.

In a possible embodiment, the identification devices 40 are also capable of displaying a message for the operator, for example a message containing instructions about the operations to be performed, and the control device 50 is configured to control the identification devices 40 so as to display any messages according to the instructions contained in the third control signal.

The control device 50 can also be operatively connected to the additional identification device 41, for example by means of electrical connections. In this case, the control signals comprise a fourth control signal containing instructions correlated to the identification code to be displayed on the electronic display of the additional identification device 41. This identification code can be read to confirm the start or completion of an operation of picking the structure 1 for its subsequent use close to the operating machine. In this way, the control unit can receive confirmation that the correct structure 1 has been picked.

The control device 50 can also be operatively connected to the sensors associated to the respective areas 20, if they are provided. In this case, the control device 50 is configured to receive an input or a signal from each sensor and to transmit to the control unit a signal correlated to this input or signal to supply to the control unit additional information correlated to the execution of the operations.

The structure 1 further comprises an electrical power source, for example an electric accumulator, electrically connected to the control device 50, to the warning devices, to the identification devices 40 (if they comprise electrical components) and to the sensors so as to power them.

Obviously, a person skilled in the art, in order to satisfy specific and contingent needs, can make numerous modifications and changes to the invention described above while remaining within the scope of protection defined by the following claims.

The invention claimed is:

1. A structure for supporting and transporting a plurality of pieces in operations of assembling/disassembling and/or change of configuration in a manufacturing line, comprising:

at least one support surface;

a plurality of areas defined on said at least one support surface, each of said areas housing a respective piece of said plurality of pieces or being configured to house a respective piece of said plurality of pieces;

a plurality of warning devices selectively actuatable automatically, each warning device being arranged at a respective area of said plurality of areas and configured to emit a signal directly perceivable by an operator so that the operator can uniquely associate the perceived signal to the respective area; and a plurality of identification devices, each identification device being arranged on said at least one support surface at a respective area of said plurality of areas to uniquely identify the respective area and uniquely associate the respective area to a respective piece of said plurality of pieces currently housed in said respective area or to be housed in said respective area.

2. The structure according to claim 1, comprising at least one further warning device selectively actuatable automatically and associated to a main face of the structure and/or to the at least one support surface.

3. The structure according to claim 1, wherein said warning devices comprise respective light sources selectively actuatable automatically.

4. The structure according to claim 3, wherein each of said light sources is configured to emit a steady or intermittent light of a color selected from a group of colors.

5. The structure according to claim 1, wherein at least some of said identification devices comprise a respective programmable electronic display configured to visually display an identification code of the piece currently housed in the respective area or of the piece to be housed in said respective area.

6. The structure according to claim 5, wherein at least some of said identification devices comprise an electronic label.

7. The structure according to claim 6, wherein at least some of said electronic labels are luminous electronic labels.

8. The structure according to claim 1, comprising a control device operatively connected to said plurality of warning devices and configured to receive a first control signal and selectively actuate and/or adjust each warning device based on said first control signal.

9. The structure according to claim 1, wherein at least some of said areas comprise respective support members configured to reversibly support respective pieces of said plurality of pieces in said at least one support surface.

10. The structure according to claim 1, wherein said at least one support surface is associated to a base provided with a plurality of wheels.

11. The structure according to claim 1, comprising two support surfaces facing opposite sides.

12. The structure according to claim 1, wherein each identification device comprises a respective warning device.

13. The structure according to claim 1, wherein each identification device is programmable to provide different information.

14. A method for assisting an operator in operations of assembling/disassembling and/or change of configuration in a manufacturing line, comprising:

providing a structure according to claim 1;

positioning the structure close to a manufacturing line; and picking a piece currently housed in a respective area of said plurality of areas to use said piece later in the manufacturing line or placing in a respective area of said plurality of areas a piece picked from the manufacturing line;

wherein said respective area is identified by selectively actuating the respective warning device upon receipt of a respective command of a predetermined sequence of commands correlated to at least some of said operations of assembling/disassembling and/or change of configuration.

15. The method according to claim 14, further comprising:

confirming that the piece has been picked from the respective area correctly or that the piece has been placed in the respective area correctly by reading an information provided by the identification device arranged at the respective area.

16. A structure for supporting and transporting a plurality of pieces in operations of assembling/disassembling and/or change of configuration in a manufacturing line, the structure comprising:

at least one support surface;

a plurality of areas defined on said at least one support surface, each of said areas being configured to house a respective piece of said plurality of pieces;

a plurality of warning devices selectively actuatable automatically, each warning device being arranged at a respective area of said plurality of areas and configured to emit a signal directly perceivable by an operator so that the operator can uniquely associate the perceived signal to the respective area; and at least one identification device arranged on said at least one support surface at a respective area of said plurality of areas to uniquely identify the respective area and uniquely associate the respective area to a respective piece of said plurality of pieces which is not yet housed in said respective area or which has already been removed from said respective area.

* * * * *